United States Patent [19]

Höffken et al.

[11] Patent Number: 4,853,031

[45] Date of Patent: Aug. 1, 1989

[54] PROCESS FOR PREPARING BINDERFREE HOT BRIQUETTES FOR SMELTING PURPOSES

[75] Inventors: Erich Höffken, Dinslaken; Rudolf Auth, Dorsten; Werner Kaas, Dinslaken; Lothar Seidelmann, Duisburg, all of Fed. Rep. of Germany

[73] Assignee: Thyssen Stahl AG, Duisburg, Fed. Rep. of Germany

[21] Appl. No.: 888,551

[22] Filed: Jul. 18, 1986

[30] Foreign Application Priority Data

Aug. 14, 1985 [DE] Fed. Rep. of Germany ..... 3529084

[51] Int. Cl.[4] ..... C22B 7/02

[52] U.S. Cl. ..... 75/0.5 R; 75/25

[58] Field of Search ..... 75/26, 0.5 R, 257, 25

[56] References Cited

U.S. PATENT DOCUMENTS 4,533,384 8/1985 Rellermeyer et al. ..... 75/0.5 R

FOREIGN PATENT DOCUMENTS 0097292 1/1984 European Pat. Off. .

1181874 2/1970 United Kingdom .

2026458 2/1980 United Kingdom ..... 75/25

*Primary Examiner*—Melvyn J. Andrews

*Attorney, Agent, or Firm*—Sprung Horn Kramer & Woods

[57] ABSTRACT

The present invention relates to a process and apparatus for preparing binder-free hot briquettes for smelting purposes consisting of iron-containing pyrophorous finely divided solids. Before briquetting, the finely divided solids are blown-through by means of a rising oxidating heated gas flow and held in a fluidized bed. During said process the gas flow is controlled in such a way that by oxidation of at least part of the metallic iron the temperature of the finely divided solids is increased to about 450° to 650° C. Subsequently, the solids are briquetted in hot condition. Characteristic for the invention is that there is added to the fluidized bed sensible heat from the outside until oxidation of part of the metallic iron starts, and that the fluidization bed is submitted to the effect of vibrations favoring the conveying of the solids over the fluidized bed.

23 Claims, 3 Drawing Sheets

PROCESS FOR PREPARING BINDERFREE HOT BRIQUETTES FOR SMELTING PURPOSES

BACKGROUND OF THE INVENTION

1. Field of the Invention

The present invention relates to a process for preparing binderfree hot briquettes for smelting purposes consisting of iron-containing pyrophorous finely divided solids, in which before the briquetting operation the finely divided solids are blown-through by means of a rising, oxidizing heated gas flow and held in a fluidized bed, the gas flow being controlled such that by oxidation of at least part of the metallic iron the temperature of the finely divided solids is increased to about 450° to 650° C., and in which subsequently the finely divided solids are hot briquetted.

2. Discussion of Prior Art

The invention relates furthermore to an apparatus for performing the said process. From DE-PS No. 32 23 205 are known a process and apparatus of this type by means of which more than 4% by weight of metallic iron-containing finely divided solids, as they are deposited in filters for instance during the manufacture of steel according to the oxygen blowing process for the recovery of CO, are fed at a temperature of more than 200° C. to a fluidized bed located directly after the filters.

But in many cases the available space in steel production plants does not allow such an arrangement so that the hot filter dust has to be transported over more or less distances to the hot briquetting apparatus. It also happens quite often that due to operational conditions intermediate storage times have to be accepted. Important transport distances and/or intermediate storage times cause cooling of the filter dusts so that when entering the fluidized bed their temperature is not sufficient and oxidation of the metallic iron does not start at all or only insufficiently.

Further difficulties arise when due to production conditions at different operational modes of the oxygen blowing converter the pyrophoric portion of the filter dust is reduced so that the oxidation of the metallic iron is not sufficient for increasing the temperature of the finely divided solids to briquetting temperature.

In the prior apparatus it is also difficult to uniformly maintain the fluidized behaviour of the finely divided solids and it is possible that there is formed a channel in the fluidized bed. Furthermore, it is difficult to exactly control the dwell time of the solids in the fluidized bed.

SUMMARY OF THE INVENTION

Object of the Invention

The present invention is based on the object to avoid the described drawbacks and to suggest a process and a suitable apparatus by means of which also cooled down finely divided pyrophoric solids as well as solids with reduced pyrophoric portion may be briquetted in an energy-saving accelerated mode by improving the fluidized behaviour of the solids in the fluidized bed, avoiding the forming of channels and providing sufficient control of the dwell time of the solids in the fluidized bed.

The present invention suggests for a process of the above described species to supply to the fluidized bed until starting of the oxidation of portion of the metallic iron sensible heat from the outside and to submit the fluidized bed to vibrations favouring the conveying of the solids in the fluidized bed. Preferably there is added to the fluidized bed sensible heat from the outside also after starting of the oxidation in order to obtain rapidly a briquetting temperature of about 450° to 800° C.

Due to the supply of sensible heat from the outside the iron is advantageously heated to ignition temperature. The admixture of further sensible heat after starting of oxidation economically accelerates the process while due tot he effect of vibrations on the fluidized bed the formation of channels is avoided and the finely divided solids may be guided over the length of the fluidized bed.

As heated oxidizing gas flow is used preferably heated air, while for the admixture of sensible heat to the fluidized bed there is preferably used hot combustion gas and/or heated inert gas, preferably heated nitrogen.

In a further inventive embodiment the air and/or inert gas is/are heated by means of the hot, preferably purified waste gas emitted by the fluidized bed by means of heat exchange. This permits a particularly energy-saving operation mode.

The heated air, the heated inert gas and the hot combustion gases are added in at least two, preferably three or more sections to the fluidized bed, the amount and temperature of the heated air, of the heated inert gas and of the hot combustion gases being controllable independently from one another.

The temperature of the fluidized bed is measured at more than one, preferably three locations and the temperature values are used for regulating/controlling the amount and temperature of the heated air, heated inert gas and hot combustion gas supplied to the fluidized bed.

Also these features contribute to an energy-saving, economical and well controllable operation mode.

In a further inventive embodiment, the amount of gas supplied to the fluidized bed is adjusted/controlled such that the total amount of heated air, heated inert gas and hot combustion gas is constant.

When the temperatures measured in the fluidized bed increase above the preset value, the supply of hot combustion gases and subsequently the supply of heated air is reduced. But when the temperatures measured in the fluidized bed decrease below the preset value, more heated air is supplied and subsequently the supplied amount of hot combustion gas is increased.

The dwell time of solids in the fluidized bed may be adjusted by changing the fluidized bed inclination or by changing the vibrations applied from the outside.

If the finely divided solids do not completely or excessively consist of pyrophoric material, part of the finely divided solids may be replaced by finely divided solid combustion material. Preferably up to 15% or up to 10% of the finely divided solids are replaced by finely divided solid combustion material. As finely divided solid combustion material may be used carbonised lignite powder and/or finely divided carbon powders obtained preferably by processing flotation slurries.

Before entering the fluidized bed the solids may be preheated by reflux of unpurified waste gas coming from the fluidized bed. It is also possible to preheat the solids in the first portion of the fluidized bed by means of heated cooling air from the briquette cooler.

It is considered as an advantage of the invention that there are solved the problems linked to processing of finely divided pyrophoric solids into hot pressed briquettes and that it is possible to heat the substances in an energy-saving mode to hot briquetting temperature. In particular, it is possible to process without any difficulty pyrophoric filter powders which, due to long transport distances and due to intermediate storing have suffered a temperature loss. Furthermore, it is possible to use filter dusts the pyrophoric portion of which has been reduced due to different operational modes of the oxygen blowing converter. The inventive process may furthermore be performed when the filtering installation is in starting condition or when cold operational conditions occur.

An apparatus for operating the inventive process, consisting of a fluidized bed reactor comprising gas conduits to the lower side of the fluidized bed, a subsequent briquetting press and a briquette cooler is characterized in that the fluidized bed reactor is equipped in a manner known per se with vibration exciters.

According to a further inventive feature the lower side of the fluidized bed reactor is designed as a chamber. In the upper chamber wall forming the reactor bottom are provided gas supply nozzles extending above the fluidized bed level and being provided with syphon-type end pieces engaging the fluidized bed.

It is furthermore of advantage when the chamber consists of at least two, preferably three or more sections each having individual gas supply conduits.

The first section may be connected by means of a conduit to a cooling air collecting hood of a continuous cooling belt of the briquette cooler. By means of said conduit the heated cooling air is fed for preheatment to the solid substance when entering the fluidized bed reactor.

The fluidized bed reactor is provided with a gas-tight hood comprising one or several, preferably two exhaust gas conduits equipped with regulating valves.

It is furthermore of advantage if the apparatus is characterized by a dust separator connected through the exhaust gas conduit(s) to the hood of the fluidized bed reactor.

The dust separator may furthermore be connected through a trough conveyor and a connecting conduit comprising regulating valves to the hood of the fluidized bed reactor. Thus, during transport to the fluidized bed reactor, the solids may be preheated in reflux by means of unpurified waste gas from the fluidized bed reactor.

After the dust separator is preferably located a heat exchanger, connected to the latter by means of a conduit and comprising heat exchanger elements for heating air and inert gas/waste gas. In a further inventive embodiment the apparatus is provided with burners for producing hot combustion gases and connected by means of gas supply conduits to the lower side of the fluidized bed reactor. The heat exchanger elements of the heat exchanger open through conduits into the gas conduits at the lower side of the fluidized bed reactor.

Distributed over the fluidized bed reactor are preferably located measuring instruments for measuring the temperature of the fluidized layer, wherein depending on the measured temperatures the temperatures and the supplied amounts of hot combustion gas, hot air and hot inert gas and their distribution in the individual sections are regulated/controlled by means of regulating/control elements known per se.

Preferably, the fluidized bed reactor is provided with adjustment devices permitting adjustment of the reactor inclination. Furthermore, it is of advantage if the vibration exciters of the fluidized bed are provided with adjustment devices permitting to adjust the vibration amplitude/vibration frequency.

DESCRIPTION OF AN EMBODIMENT OF THE INVENTION

Brief Description of the Drawings

As an example of the inventive process and of the inventive apparatus one embodiment is described hereafter in detail by means of the drawing. In the drawing shows.

DETAILED DESCRIPTION OF THE EMBODIMENT OF THE INVENTION

Figure 1:
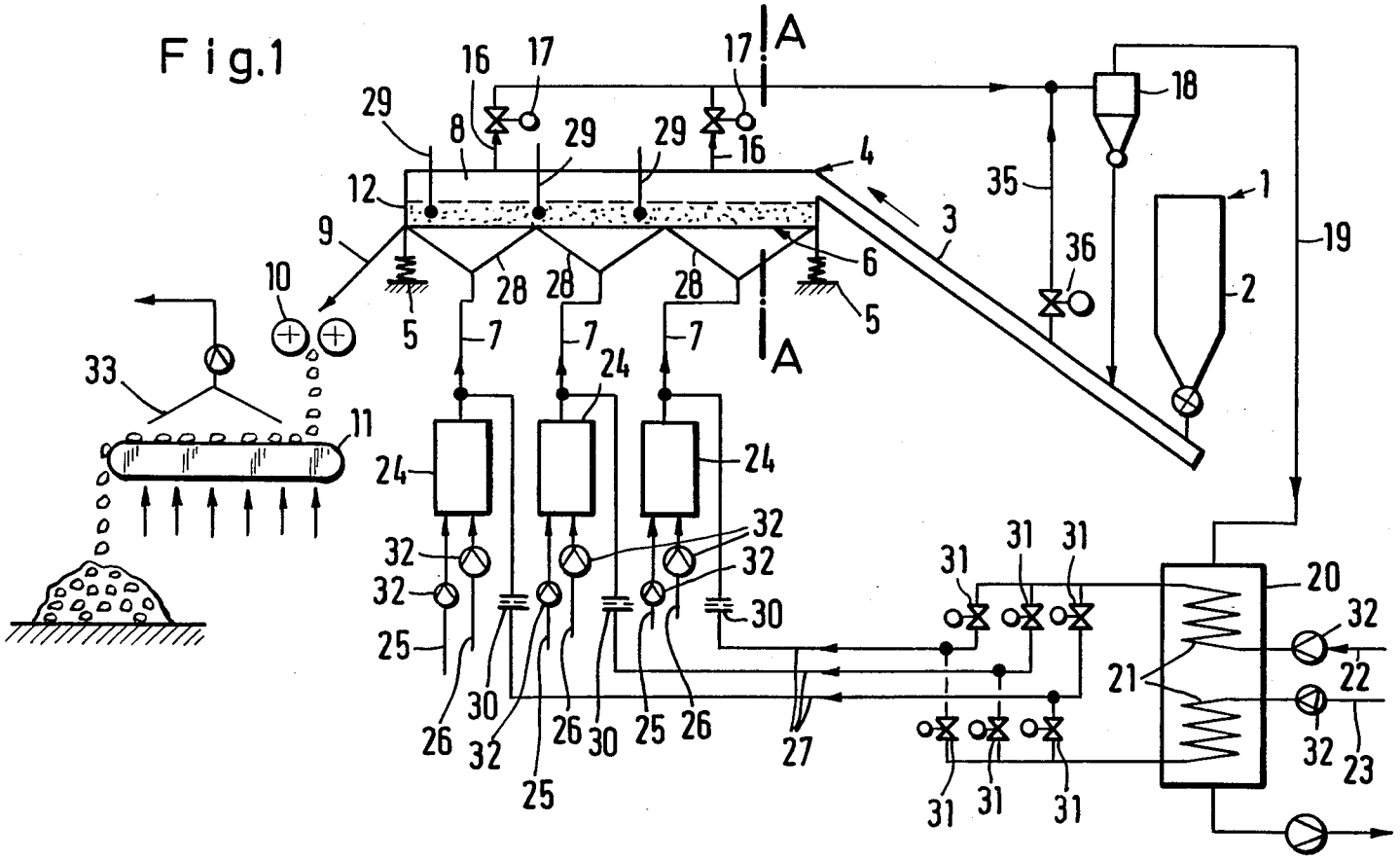
In FIG. 1 the inventive installation for hot briquetting of pyrophoric filter dust recovered from a CO-recovery installation of an oxygen blowing converter is depicted, In FIG. 2 a section through the fluidized bed reactor along line A—A is depicted In FIG. 3 a second inventive installation is depicted.

The pyrophoric filter dust recovered filter elements of a CO-recovery apparatus of an oxygen blowing converter (not shown) is fed, as shown in FIG. 1, through conduit 1 into dust silo 2 from which it is conveyed through trough conveyor 3 to a fluidized bed reactor 4. The elongated fluidized bed reactor 4 supported on vibration elements in the form of springs 5, is provided with a gas-permeable bottom 6, gas supply conduits 7 and a hood 8. Fluidized bed reactor 4 is excited by means of not represented vibration exciters, coupled to the reactor 4 in a manner known per se.

The filter dust heated to briquetting temperatures in fluidized bed reactor 4 is fed through an outlet 9 to a briquetting press 10 in which said filter dust is pressed into briquettes. The finished briquettes are conveyed for cooling onto a briquette cooler designed in the form of an endless belt 11, the cooling of the briquettes being obtained by the passing environmental air. The heated cooling air is collected by a hood 33 and exhausted. Subsequently, the cooled briquettes are conveyed into a bunker from which they may be taken for use in a steel production plant.

Figure 2:
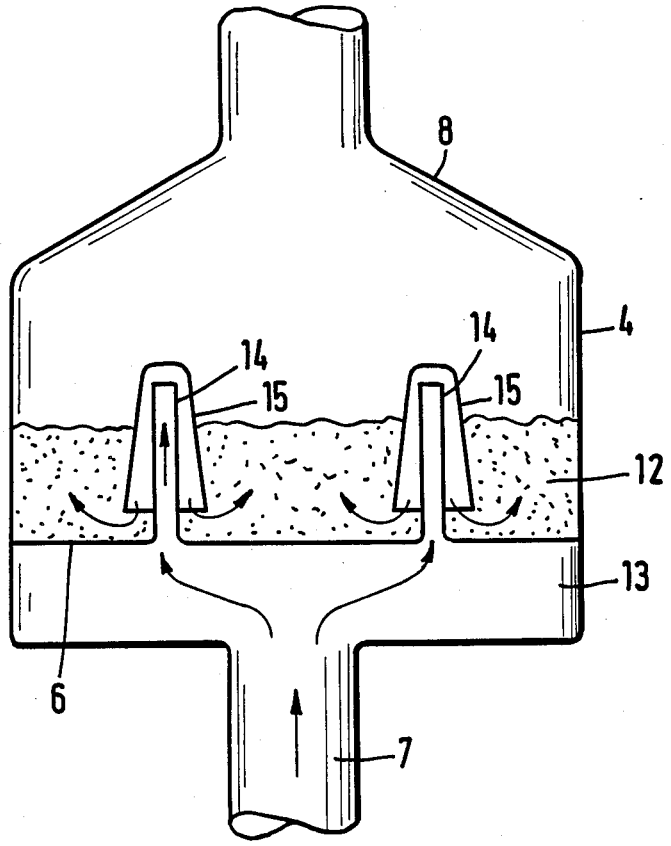

For creating fluidized bed 12, the fluidized bed reactor 4 comprises, as shown in FIG. 2, a chamber 13, the upper chamber wall 6 of which forms the bottom of reactor 4, is designed to be gas-permeable. For this purpose are provided gas supply nozzles 14 in bottom 6 which extend above the fluidized bed level. Gas supply nozzles 14 are provided with syphon-type end pieces 15 engaging fluidized bed 12.

Hood 8 of fluidized reactor 4 comprises two exhaust conduits 16 provided with regulating valves 17. Through said waste gas conduits the hot waste gas is fed to a dust separator 18.

The hot waste gas partly also may be supplied in reflux through the trough conveyor 3 to the transported filter dust and fed through a connecting conduit 33 provided with regulating valves 36 to the dust separator 18. Thus the filter dust is already preheated in the trough conveyor 3. This is particularly advantageous for processing cold coarse filter dust.

The filter dust particles separated from the waste gas in the dust separator 18 are returned through the trough conveyor 3 to the fluidized bed reactor 4. The hot purified waste gas is supplied through a conduit 19 to a heat exchanger 20. Said heat exchanger 20 comprises heat exchanger elements 21 for heating air and inert gas/-waste gas.

The apparatus furthermore comprises three burners 24 for producing hot combustion gas. This is obtained by combustion of natural gas with air supplied through conduits 25 and 26. Burners 24 are connected to the gas supply conduits 7 of the fluidized bed reactor 4. The gas supply conduits 7 are further connected through conduits 27 with the heat exchanger elements 21 of the heat exchanger 20. The chamber 13 of the fluidized bed reactor 4 is, as shown FIG. 1, subdivided into three sections 28 into which open the gas supply conduits 7. In the fluidized bed reactor 4 are located temperature gauges 29 permitting measurement of the temperature of the various areas of the fluidized bed 12. The measured temperature values are fed to controlling/regulating elements 17, 30 and 31 known per se and provided in lines 16 and 27, as well as to ventilators 32 provided in lines 22, 23, 25 and 26 through which the temperatures and added amounts of hot combustion gas, hot air and hot inert gas are controlledregulated.

The fluidized bed reactor 4 comprises adjustment devices (not shown) through which the reactor inclination may be adjusted. The not shown vibration exciters are further provided with adjustment devices (not shown) through which the vibration amplitudevibration frequency may be adjusted.

Figure 3:
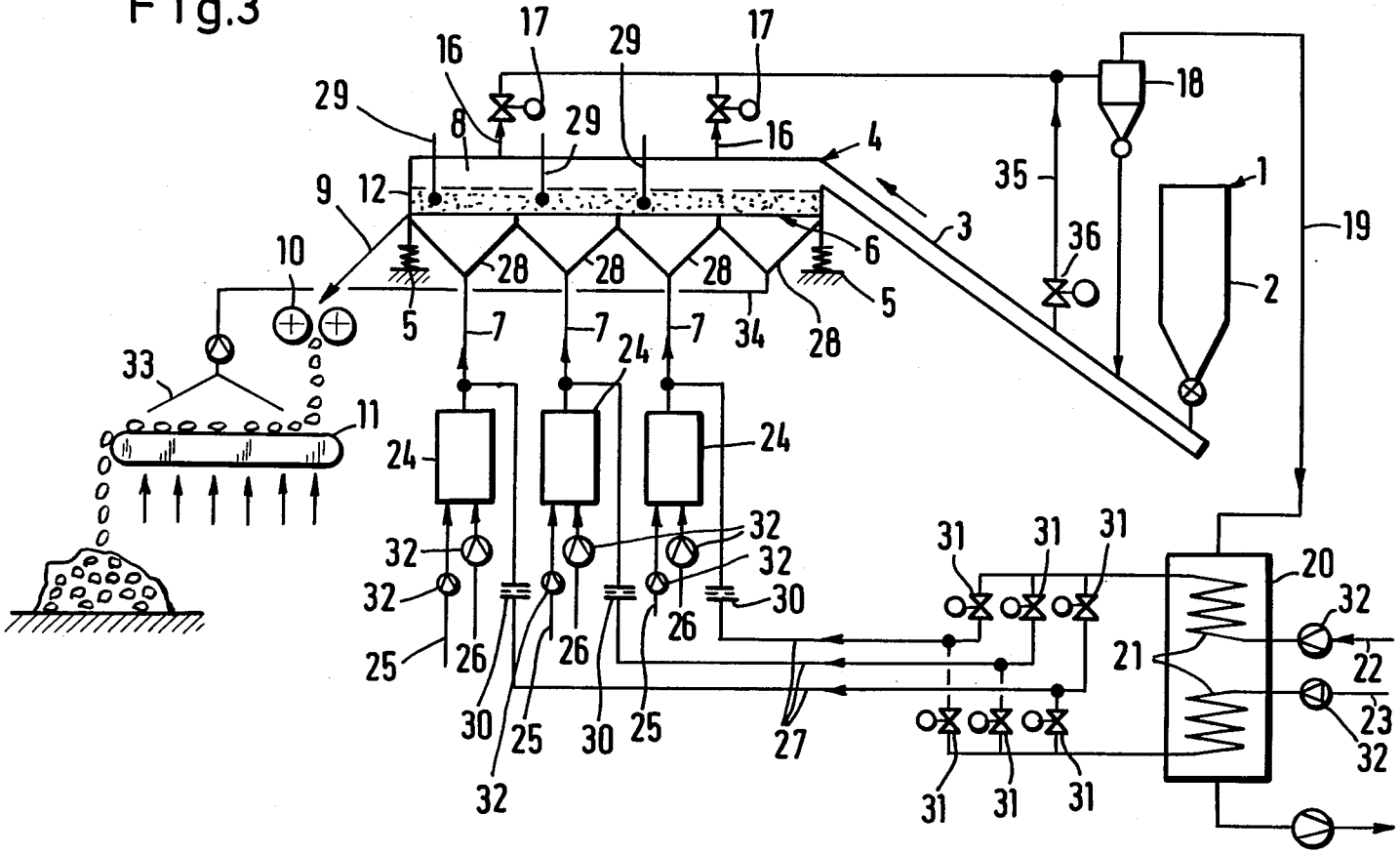

FIG. 3 shows an inventive apparatus conforming with the apparatus shown in FIG. 1. The used reference numerals are the same, but the fluidized bed reactor 4 is provided with four sections 28, the first being connected through conduit 34 to cooling air collecting hood 33 of the cooling belt 11, while the remaining three sections, as shown in FIG. 1, are connected to the burners 24. Thus it is possible to advantageously use the heated cooling air collected by the hood 33 for preheating the filter dust in the first portion of the fluidized bed reactor 4.

The values summarized in the table hereafter serve to further explain the present invention.

| | Example | | |
|---|---|---|---|
| filter dust | 1 fine dust | 2 coarse dust | 3 fine dust with fuel |
| chemical analysis: | | | |
| Fe met-contents (% by mass) | 25 | 17 | 6 |
| $Fe^{++}$-contents (FeO) (% by mass) | 17 | 17 | 12 |
| $Fe^{+++}$-contents ($Fe_2O_3$) (% by mass) | 30 | 12 | 45 |
| CaO-contents (% by mass) | 4 | 10 | 3 |
| fuel admixture (% by mass) | — | — | 5 |
| filter outlet temp. (°C.) | 220 | 120 | 40 |
| filter dust temp. silo (°C.) | 200 | 80 | 30 |
| filter dust temp. inlet fluidized bed reactor (°C.) | 190 | 60 | 20 |
| filter dust temp. outlet fluidized bed reactor (°C.) | 800 | 700 | 750 |
| briquetting at roll pressure (kN/cm roll width) | 100 | 100 | 100 |
| briquette cooling on belt cooler (°C.) | 50 | 40 | 60 |
| quality of briquettes: | | | |
| (a) density (g/cm$^3$) | 4 | 5,2 | 4 |
| (b)cold-shortness (daN/briquette) | 200–500 | 200–500 | 200–500 |
| further processing in | steel production plant | steel production plant | steel production plant |

The fine and coarse dusts of examples 1, 2 and 3 come from the filter system of a CO-recovery apparatus of an oxygen blowing converter.

The fine and coarse dusts of examples 1 and 2 have been separated during normal operation condition. The numerical values show the cooling of the dust due to transport between the filtering system and the fluidized bed reactor and due to storage in the silo. The fine dust of example 3 has been recovered in the starting operation of the filter system. Consequently, it presents right from the start lower temperature and lower pyrophoric contens.

What is claimed is:

1. A process for preparing binderfree hot briquettes for smelting purposes comprising fluidizing in a fluidized bed reactor a fluidized bed of metallic iron-containing pyrophoric finely divided solids, prior to conducting an oxidation of at least a portion of the metallic iron in the solids, supplying sensible heat from outside the fluidized bed reactor to the fluidized bed, until the start of the oxidation, subjecting the fluidized bed to vibrations to aid in a conveying of the solids through the reactor, introducing a heated oxidizing gas below said bed to form a heated oxidizing gas flow, controlling the oxidizing gas flow by conducting an oxidation of at least a portion of the metallic iron in the solids, the temperature of the solids being increased up to a range of 450° C. to 650° C., to provide heated solids, conveying said heated solids through the reactor, introducing heated solids into a briquetting operation and hot briquetting said heated solids to form binder free hot briquettes.

2. A process according to claim 1, which further comprises supplying additional sensible heat from outside the reactor to the bed after the start of the oxidation in order to rapidly attain a temperature of the solids from the hot briquetting operation of 450° to 800° C.

3. A process according to claim 1, wherein the heated oxidizing gas is heated air.

4. A process according to claim 3, further comprising heating the oxidizing gas by means of a heat exchange of a waste gas emitted from the reactor which waste gas has been purified by being passed through a dust separator.

5. A process according to claim 1, wherein the sensible heat is supplied by hot combustion gas, heated inert gas or a mixture thereof.

6. A process according to claim 5, wherein the heated inert gas is heated nitrogen.

7. A process according to claim 5, further comprising heating the inert gas by means of a heat exchange with a waste gas emitted from the reactor which waste gas has been purified by being passed through a dust separator.

8. A process according to claim 5, wherein the fluidized bed has at least two sections and wherein the heated oxidizing gas, the hot combustion gas and/or the heated inert gas is supplied to the fluidized bed in at least two sections.

9. A process according to claim 5, wherein the fluidized bed has at least three sections and wherein the heated oxidizing gas, the hot combustion gas and/or the heated inert gas is supplied to the fluidized bed in at least three sections.

10. A process according to claim 5, further comprising regulating the amount and temperature of the heated oxidizing gas, heated iner gas and/or combustion gas independently from one another.

11. A process according to claim 10, further comprising measuring the temperture of the fluidized bed at more than one location in the bed and using the resultant measured temperatures for regulating the amount and temperature of the oxidizing gas, hot combustion gas and/or heated inert gas.

12. A process according to claim 11, wherein the temperature is measured at three locations in the bed.

13. A process according to claim 5, further comprising regulating the amount of gases supplied to the fluidized bed such that the total amount of heated oxidizing gas, heated inert gas and/or combustion gas is constant.

14. A process according to claim 5, further comprising reducing teh supply of hot combustion gas and/or heated inert gas and subsequently reducing the supply of heated oxidizing gas when the fluidized bed temperature increases above a preset temperture value.

15. A process according to claim 5, further comprising increasing the supplied amount of heated air and subsequently the supplied amount of hot combustion gas when the temperature measured in the fluidized bed drops below a present valve.

16. A process according to claim 1, further comprising providing a reactor which is inclined and varying the inclination of the reactor in order to adjust the solids dwell time in the bed.

17. A process according to claim 1, further comprising varying the vibrations in order to adjust the solids dwell time in the bed.

18. A process according to claim 1, wherein said fluidized bed comprises up to 15% of finely divided solid combustion material.

19. A process according to claim 1, wherein said fluidized bed comprises up to 10% of finely divided solid combustion material.

20. A process according to claim 17, wherein the finely divided solid combustion material is selected from the group consisting of lignite dust, finely divided carbon dust and mixtures thereof.

21. A process according to claim 17, wherein the finely divided solid combustion material is produced by processing flotation slurries.

22. A process according to claim 1, further comprising recovering hot unpurified waste gas from the reactor and preheating the solids prior to introducing the solids into the fluidized bed reactor by reflux with the hot unpurified waste gas.

23. A process according to claim 1, further comprising preheating the solids in a first section of the fluidized bed by heated air from a briquette cooler.

* * * * *